US006382160B2

(12) United States Patent
Hüsges et al.

(10) Patent No.: US 6,382,160 B2
(45) Date of Patent: May 7, 2002

(54) INTERNAL COMBUSTION ENGINE HAVING A CARBURETOR

(75) Inventors: Markus Hüsges, Bad Wiessee; Gerhard Stoll, Winnenden; Maximilian Stell, Esslingen, all of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/846,190

(22) Filed: May 2, 2001

(30) Foreign Application Priority Data

May 4, 2000 (DE) ..... 100 21 706

(51) Int. Cl.[7] ..... F02M 29/00
(52) U.S. Cl. ..... 123/184.46
(58) Field of Search ..... 123/184.46, 195 A, 123/41.22, 41.31, 184.21, 184.55, 184.23, 184.32, 184.39, 198 E, 73 PP

(56) References Cited

U.S. PATENT DOCUMENTS 3,769,954 A * 11/1973 Morgenroth ..... 123/198 E
4,224,919 A * 9/1980 Appelbaum ..... 123/198 E
5,474,039 A * 12/1995 Doragrip ..... 123/184.55
5,645,026 A * 7/1997 Schlessmann ..... 123/184.46
6,257,179 B1 * 7/2001 Uenoyama et al. ..... 123/65 R

* cited by examiner

*Primary Examiner*—Marguerite McMahon
*Assistant Examiner*—Hyder Ali
(74) *Attorney, Agent, or Firm*—Walter Ottesen

(57) ABSTRACT

The available space within the apparatus housing (2) in the portable handheld work apparatus is limited so that the individual components have to be accommodated in a tight space. In work apparatus having internal combustion engines, this means that the carburetor (7) is flange connected directly to the engine block (12) in the region of the inlet opening (11). A spacer (9) is provided in order to avoid unfavorable heat effects on the carburetor (7) and to provide an advantageous mounting position. The spacer (9) is positioned between the engine (10) and the carburetor (7). The spacer (9) has a channel section (18) which runs diagonally to the respective flange planes (19, 20) of the spacer (9). This channel section (18) connects the intake channel (21) of the carburetor (7) to the inlet opening (11) of the engine (10).

16 Claims, 8 Drawing Sheets

INTERNAL COMBUSTION ENGINE HAVING A CARBURETOR

FIELD OF THE INVENTION

The invention relates to an internal combustion engine having a carburetor and especially to an engine for a portable handheld work apparatus wherein the carburetor is connected via an intermediate piece to the engine.

BACKGROUND OF THE INVENTION

In handheld work apparatus, the available space within the apparatus housing is very limited so that the individual components must be accommodated in a tight space. This concerns also the arrangement of the carburetor on the internal combustion engine so that often the carburetor is flange-connected directly to the engine block in the region of the inlet opening. However, this leads to unwanted temperature influences especially in engines having high heat generation and, for inlet openings lying high on the engine block, this leads to required forms of the housing which extend beyond the wanted housing contour. Furthermore, the extreme position of the carburetor can also lead to a poor accessibility of the adjusting screws or an unfavorable mounting of the actuating means for the starter flap and/or the carburetor flap.

To reduce the unwanted temperature influences, it has already been suggested to provide an intermediate piece having an insulating function between the engine block and the carburetor. In order to take up as little mounting space as possible, this intermediate piece has been configured in the form of a prism so that the carburetor has only a very close spacing to the engine block on the side on which the prismatic intermediate piece has its tip. For this reason, the desired insulating effect is very inadequate.

SUMMARY OF THE INVENTION

It is an object of the invention to provide an internal combustion engine with a carburetor wherein the carburetor is substantially uninfluenced by the development of heat of the engine and wherein the carburetor assumes a relative position with which the design of the housing is simplified. It is also an object of the invention to provide such an engine especially for a portable handheld work apparatus.

The internal combustion engine assembly of the invention is for a portable handheld work apparatus and includes: an internal combustion engine having an inlet opening and an engine block; a carburetor having an intake channel; a spacer for connecting the carburetor to the engine; the spacer having a channel section formed therein fluidly connecting the intake channel to the inlet opening; the spacer having a first flange lying in contact engagement with the engine block and a second flange for receiving the carburetor; the first and second flanges defining first and second flange planes, respectively, extending at least approximately parallel to each other; and, the channel section extending inclined to the flange planes.

The present invention is of special advantage in portable handheld work apparatus wherein the engine has an inlet opening very high on the engine block and, as a consequence, the carburetor would have to have an outboard or projecting housing contour. The carburetor is clearly offset in the direction of the crankcase by the spacer according to the invention and the channel running at an incline and, at the same time, an adequate spacing of the entire flange surface of the carburetor to the engine block is achieved.

A practical configuration of the spacer provides that the channel section runs along a straight line over its entire length and the longitudinal axis has the same angles to both flange surfaces. In this way, no flow deflection is required within the channel section and the angles, which are formed with respect to the contiguous components and/or the inlet openings do not operate disadvantageously on the flow of the intake air or on the flow of the mixture. The angle, which the longitudinal axis of the channel section has to the respective flanges can, for example, in each case be approximately 70°. Practically, the planes of the flanges run at least approximately parallel to the piston axis of the engine.

An air guiding plate is mounted on the spacer so that the cooling air for the engine can be maintained as a cooling air flow between the cooling ribs and so that the cooling air cannot branch off uncontrolled laterally from the engine block where it would reach the mounting region of the carburetor. The air guiding plate extends on the engine block at a spacing to the ends of the cooling ribs. This air guiding plate is advantageously planar and runs preferably in plane a parallel to the flange planes of the spacer. The air guiding plate is provided with at least one reinforcement element on the side facing away from the engine block and this reinforcement element is preferably in the form of a rib. In this way, the air guiding plate is configured so as to save as much material as possible and so that the component nonetheless has an adequate stiffness. It is practical to manufacture the spacer as one piece with the air guiding plate in order to minimize the number of individual parts and to reduce assembly costs. The spacer is preferably an injection-molded part.

In a special configuration of the invention, a pulse channel is integrated into the air guiding plate and the spacer. Such a pulse channel serves to utilize periodic pressure fluctuation for driving a gasoline pump mounted in the carburetor housing. These periodic pressure fluctuations arise in the crankcase of the engine block during operation of the engine so that the pulse channel leads from the engine block or crankcase to a membrane pump. In a practical configuration, the beginning of the pulse channel is configured as a connecting stub directed toward the engine block at an angle to the air guiding plate and the other end of the pulse channel is configured as an opening at the carburetor flange of the spacer.

In the spacer, openings are provided for fastening means or for passing fastening elements therethrough laterally next to the channel section. These openings are preferably configured as essentially cylindrical holes which extend parallel to each other and are arranged orthogonally to the flange plane. The cylindrical holes are provided, in part, for attaching the spacer to the engine block and, in part, for attaching the carburetor on the spacer. Also, these cylindrical holes start at one end of the spacer at the flange plane next to the channel section and end offset to the channel section because of the orthogonal course to the flange plane on the other side of the spacer. For this reason, the cylindrical holes lie in different planes referred to the elevation of the spacer. Insofar as the holes are provided for holding screws, these holes can be provided with insert parts which have an inner thread.

The assembly is facilitated in that all screws are screwed in orthogonally to the cylinder axis. The purger is on top and is therefore easily accessible. The intermediate piece or spacer having integrated flanges provides a space saving configuration.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
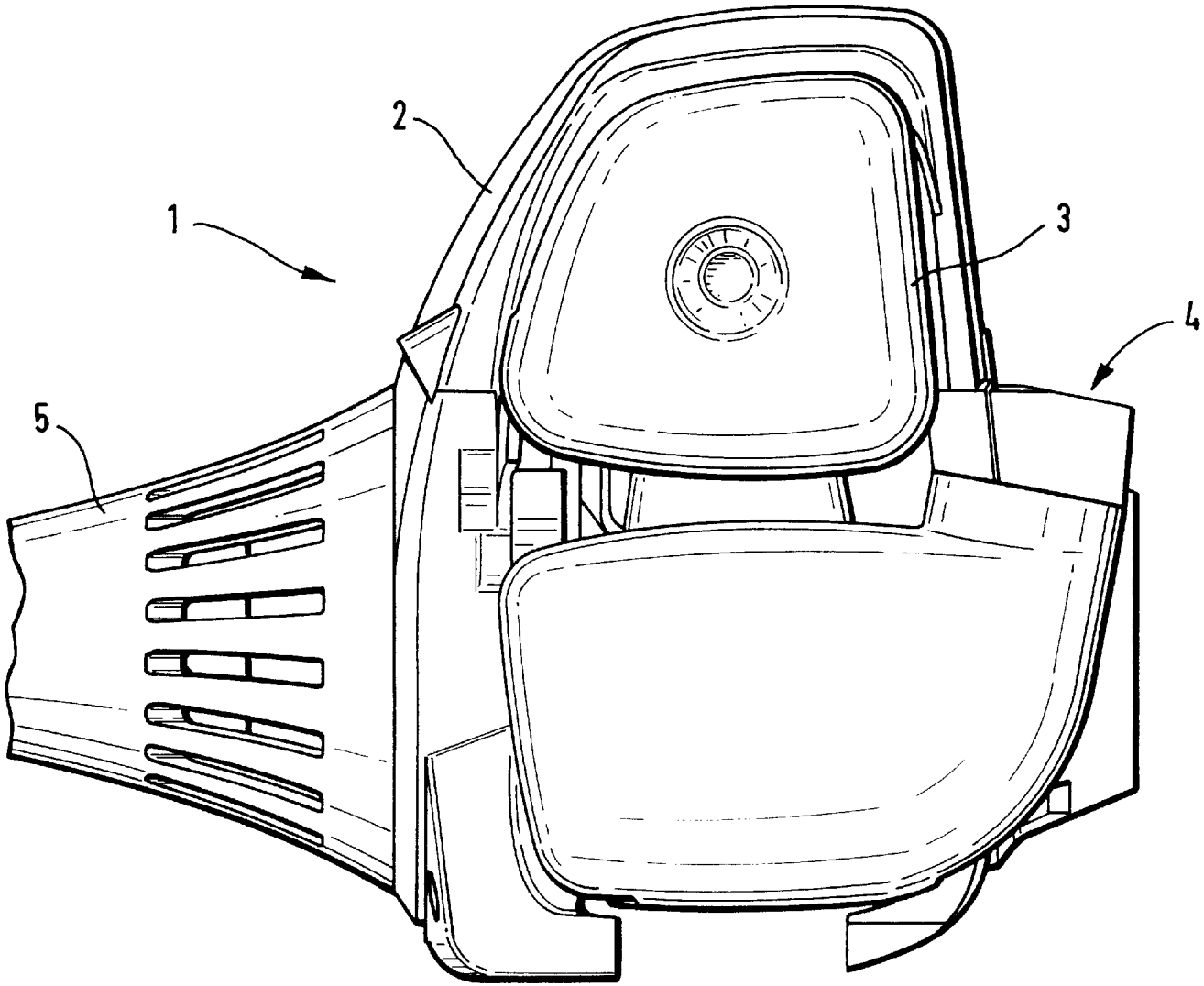
FIG. 1 is a section of the housing of a portable work apparatus for accommodating an internal combustion engine.
Figure 2:
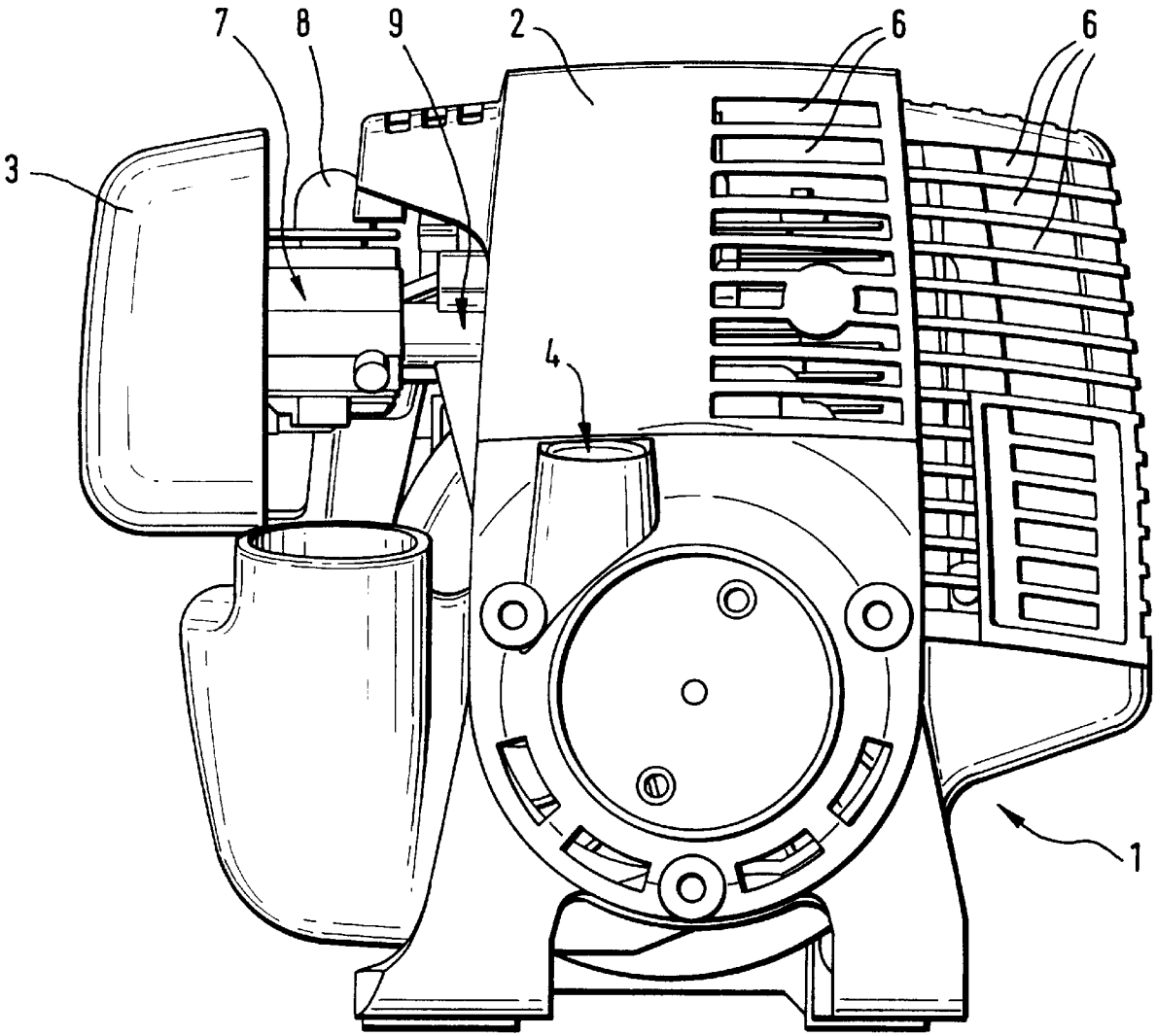
FIG. 2 is a view of the housing of FIG. 1 rotated by 90°.

In FIGS. 1 and 2, a drive unit 1 for a portable handheld work apparatus is shown in two views. This drive unit includes a housing 2 having an internal combustion engine mounted therein. A carburetor 7 and an air filter 3 are assigned to the engine. A plurality of slits 6 are provided in the housing 2 in order to allow an adequate cooling air flow to pass into and out of the housing. A purger 8 is mounted on the top end of the carburetor 7. The carburetor 7 is attached to the engine with a spacer 9 disposed therebetween. A pull-rope starter 4 is provided for starting the engine.

Figure 3:
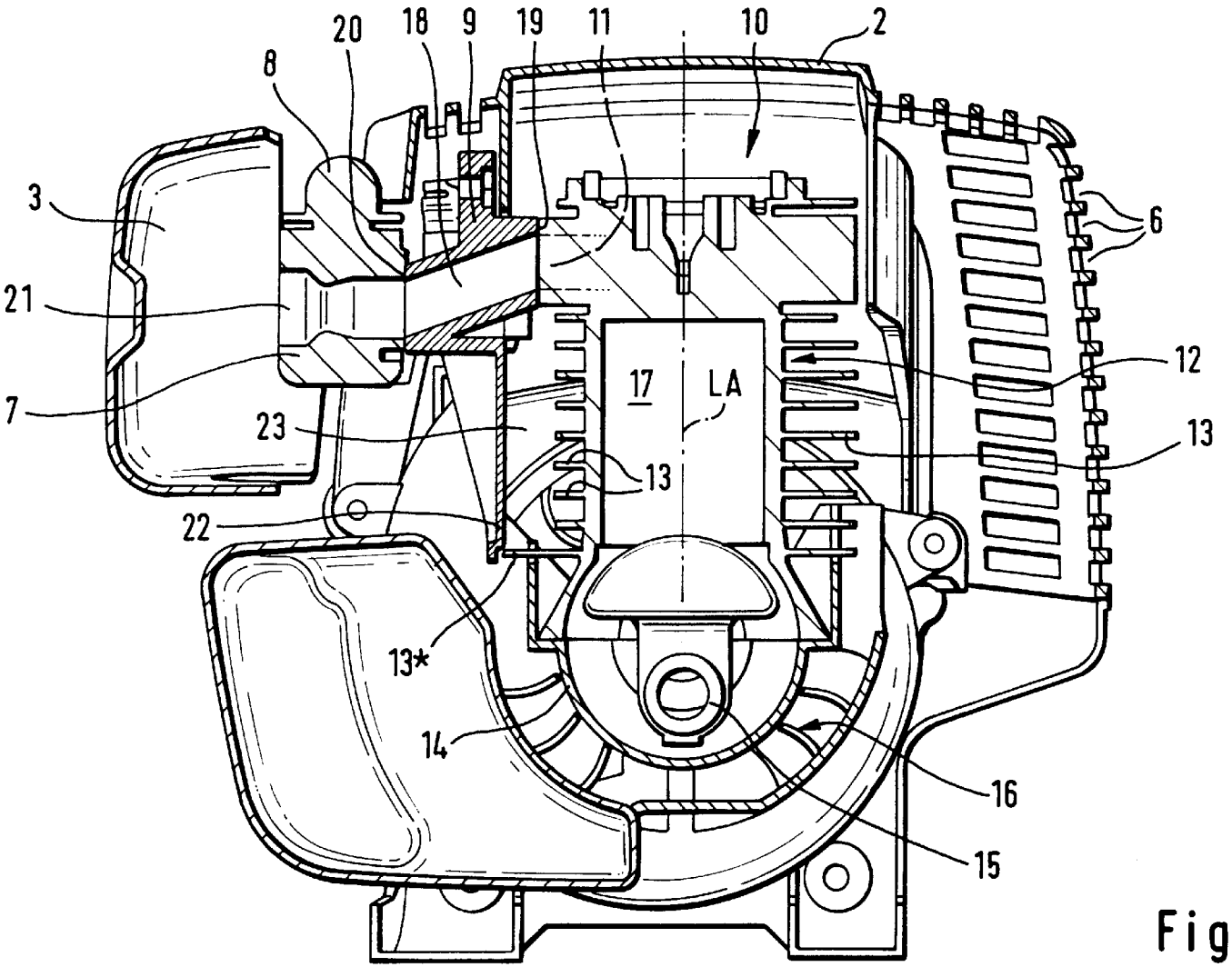
FIG. 3 is a section view through the housing and the engine of FIG. 1.

FIG. 3 shows a section through the housing 2 and a drive motor 10 of the drive unit 1. The illustration shown in FIG. 3 is somewhat larger than that shown in FIG. 2. From FIG. 3, it can be seen that the engine 10 includes an engine block 12 having cooling ribs 13 formed on the outside thereof as well as a crankcase 14 at the lower end thereof. An inlet opening 11 is provided above a cylinder 17. The air/fuel mixture is supplied to the cylinder 17 through the inlet opening 11. The piston longitudinal axis is identified in FIG. 3 by LA. A fan wheel 16 can be seen in the lower region of the engine 10 and is provided for generating a cooling air flow. This fan wheel 16 is driven by the crankshaft 15.

The spacer 9 is attached to the engine 10 in such a manner that an engine end flange 19 surrounds the inlet opening 10 of the engine. A channel section 18 is arranged in the spacer 9 and is coincident with its end on flange 19 with the inlet opening 11. From there, the channel section 18 extends diagonally downwardly to a second flange 20 on which the carburetor 7 is flange mounted. The carburetor 7 includes an intake channel 21 which is connected via the channel section 18 in the spacer 9 to the inlet opening 11 of the engine 10. As shown in FIG. 3, the surfaces of the flanges 19 and 20 of the spacer 9 are parallel to each other and they are likewise parallel to the axis LA of the piston or cylinder 17. An air guiding plate 22 is provided on the lower side of the spacer 9 and extends to the lowest cooling rib 13*. The lowest cooling rib 13* is located on the side facing toward the air guiding plate 22 and extends up to the air cooling plate 22. For this reason, an air guiding channel 23 for the engine cooling air is formed between the air guiding plate 22 and the engine block 12.

The purger 8 can be seen above the carburetor 7 in FIG. 3. The mounting position of the carburetor 7 is dictated by the flanges (19, 20). Because of this mounting location, the purger 8 is easily accessible between the housing 2 and the air filter 3.

Figure 4:
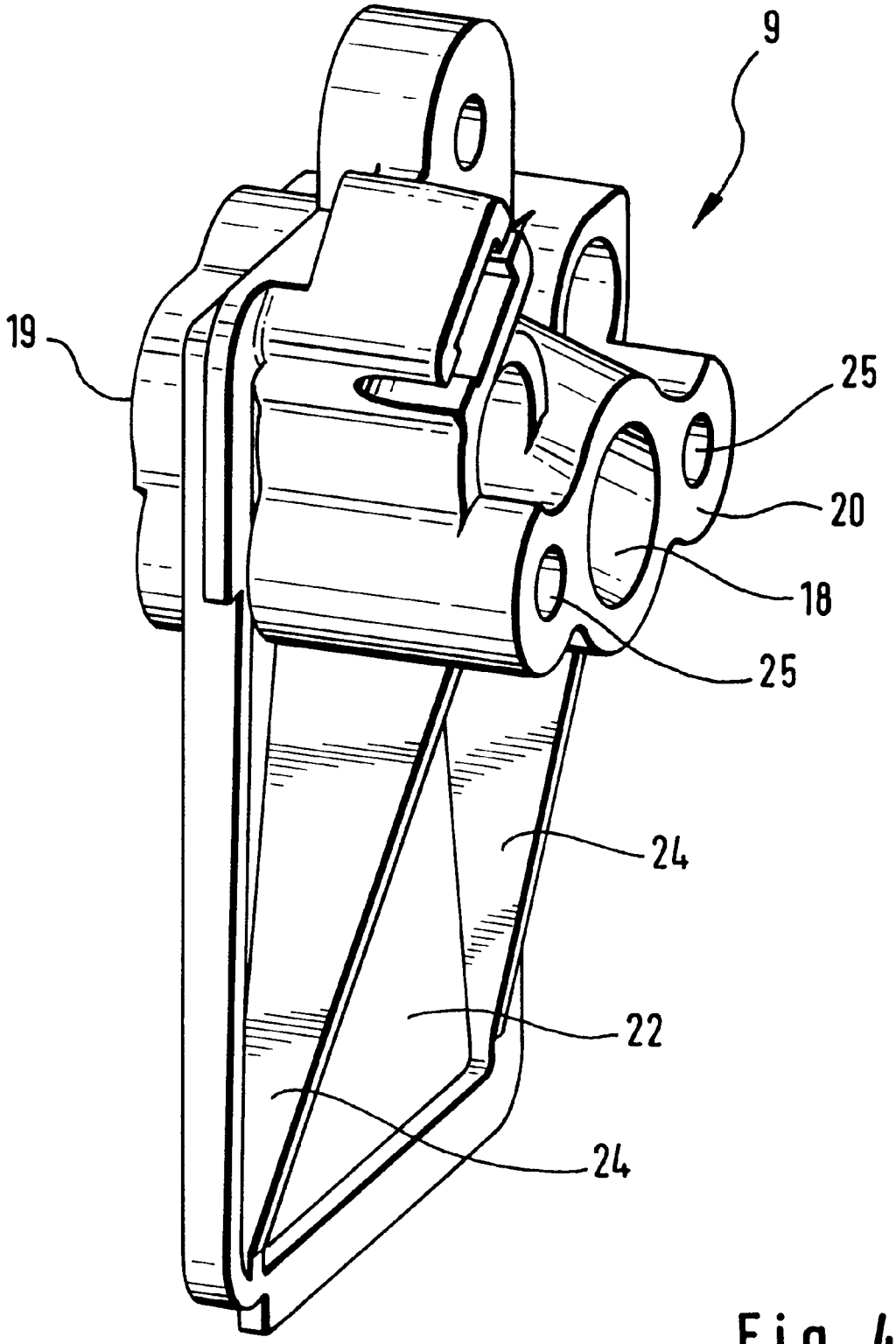
FIG. 4 is a perspective view of a spacer having an air guiding plate formed thereon.
Figure 6:
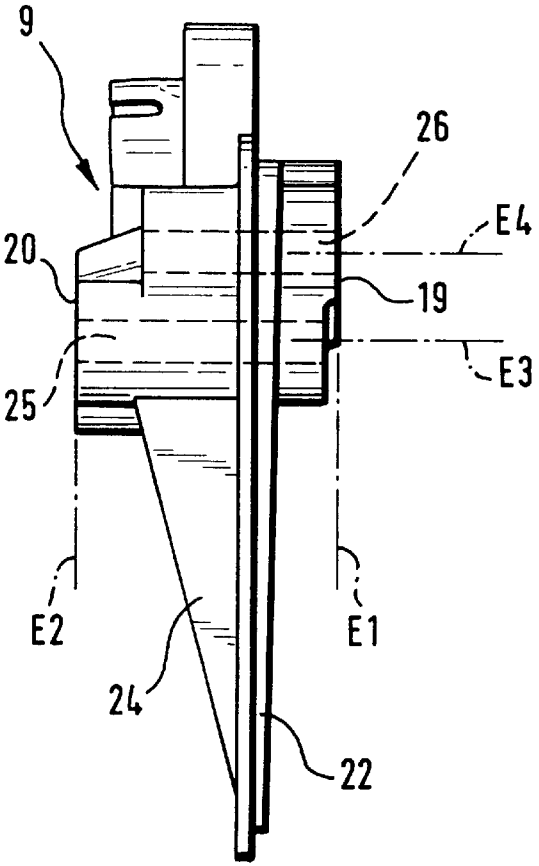
FIG. 6 is a side elevation view of the component of FIG. 5.
Figure 5:
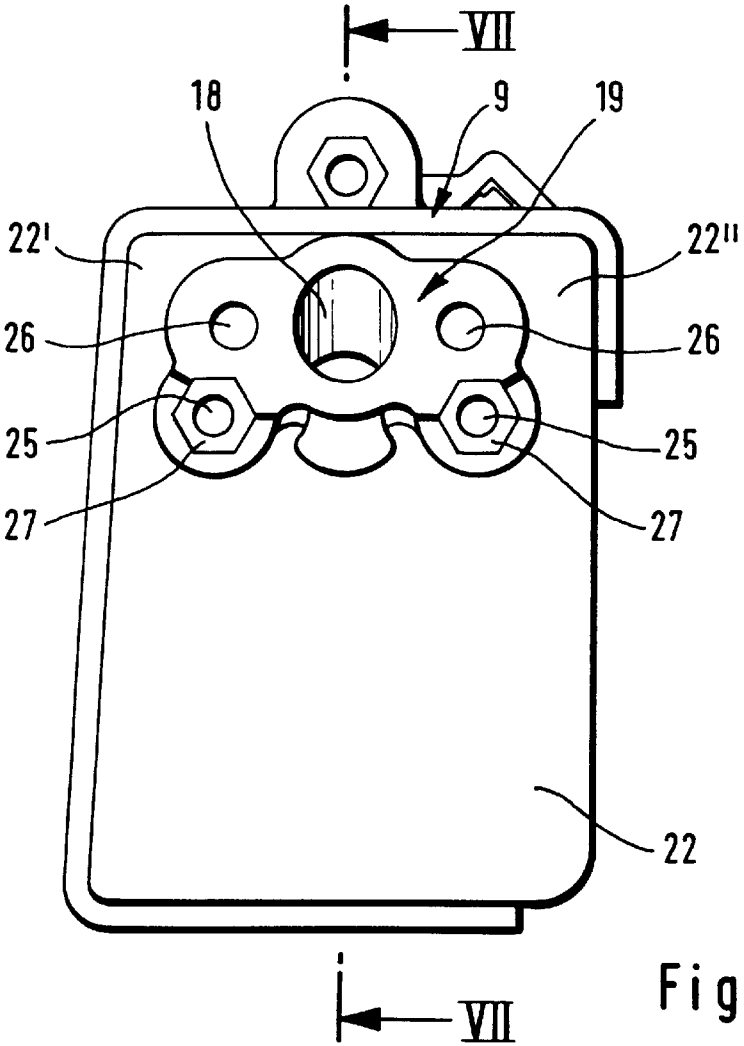
FIG. 5 is a view of the component shown in FIG. 2 viewed in the direction toward the carburetor end flange.
Figure 7:
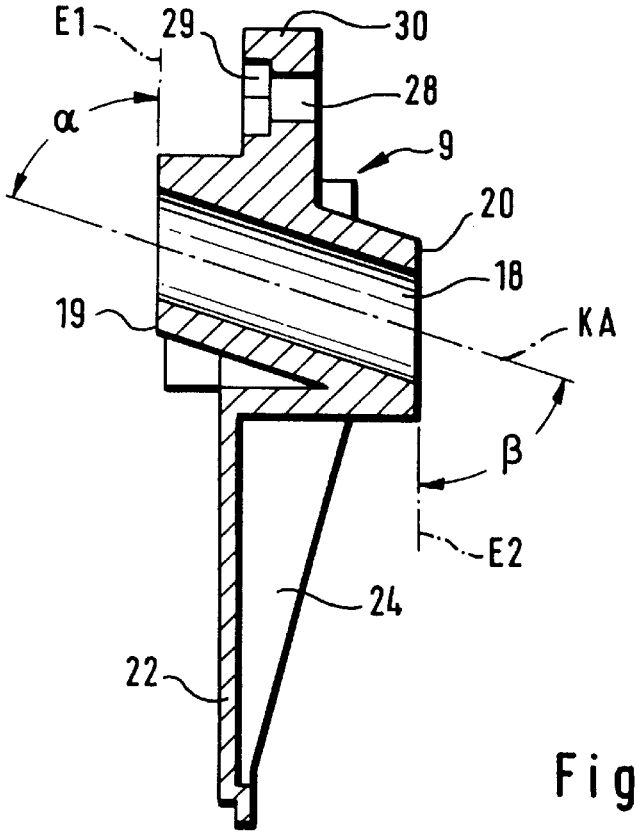
FIG. 7 is a section view taken along line VII—VII of FIG. 5.

The spacer 9 and the air guiding plate 22 are shown in different views in FIGS. 4, 5 and 6. FIG. 4 shows a perspective view of the spacer 9 and the air guiding plate 22 with the view toward the carburetor end flange 20. The engine end flange 19 is located on the opposite side. In FIGS. 4, 5 and 7, the channel section 18 is shown and ends at respective flanges 18 and 20 and extends in a straight line between these flanges. As shown in FIGS. 4, 5 and 6, openings 25 for receiving fastening elements or for allowing fastening elements to pass therethrough extend from the flange 20 to flange 19. These openings 25 are in the form of cylindrical holes such as bores. The center axes of the openings 25 are arranged approximately in the same plane as the center point of the opening of the channel section 18 on the carburetor end flange 20. Furthermore, openings 26 are provided which are likewise configured as passthrough holes and have center axes approximately at the same elevation as the center point of the opening of the channel section 18 on the engine end flange 19. As shown in FIG. 6, the openings 25 and 26 extend parallel to each other but lie in different planes. Furthermore, as shown in FIG. 5, insert parts 27 having an internal thread can be provided in the openings 25 and these inserts can, for example, be in the form of nuts. From FIGS. 4 and 6 it can be seen that ribs 24 for stiffening are provided on the side of the air guiding plate 22 facing away from the engine. As seen in FIG. 5, the air guiding plate 22 also includes sections 22' and 22" extending laterally next to the spacer 9 so that a passthrough of an unwanted airflow past the spacer 9 to the carburetor is prevented.

Figure 8:
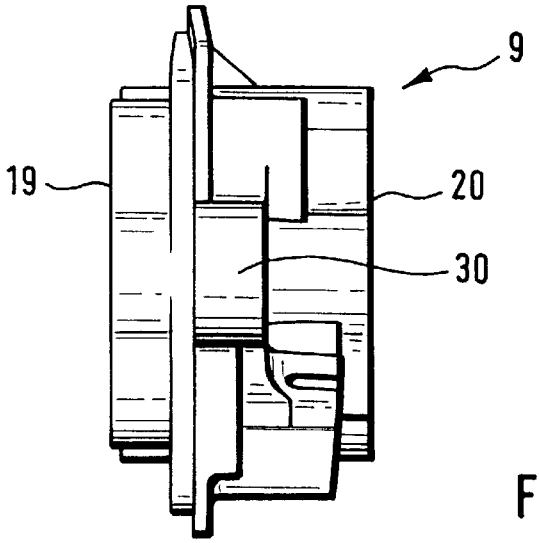
FIG. 8 is a plan view of the component of FIG. 7.
Figure 10:
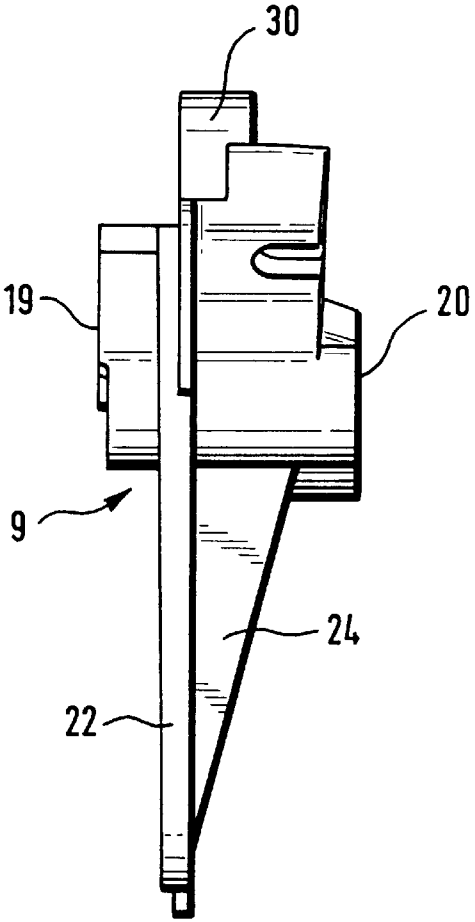
FIG. 10 is a side elevation view of the component of FIG. 9.
Figure 9:
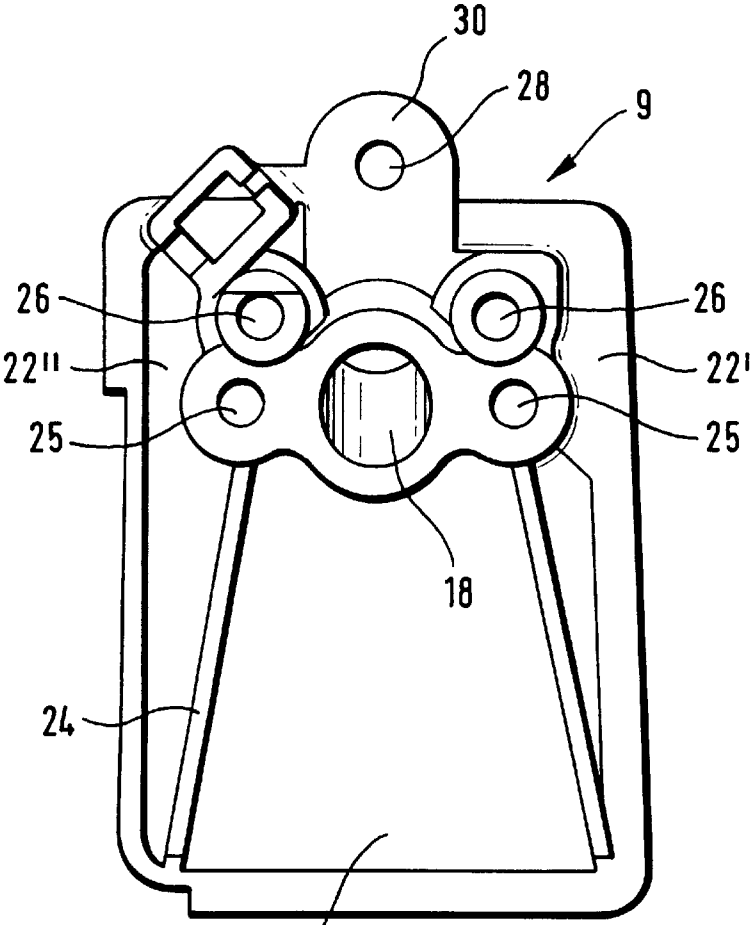
FIG. 9 is a view of the component of FIG. 7 as seen in the direction toward the engine end flange.

FIG. 7 shows a section taken along line VII—VII of FIG. 5. From FIG. 7 it can be seen that the upper end of the spacer 9 has a lug 30 formed thereon in which an attachment opening 28 having a cutout 29 is provided for receiving an insert part such as a nut. This nut can serve for attaching a tension piece for the adjustment of the throttle pull. Furthermore, FIG. 7 shows that a center axis KA of the channel section 8 defines angles $\alpha$ and $\beta$ of approximately 70° with respect to planes E1 and E2 of the flanges 19 and 18, respectively. FIGS. 8, 9 and 10 show additional views of the spacer 9 and of the air guiding plate 22. The reference numerals in FIGS. 8, 9 and 10 are the same for the same parts shown in FIGS. 4 to 7.

With the configuration of the spacer 9, it is ensured that the throttle pull mounting and the adjusting screws of the carburetor 7 are easily accessible. A horizontal introduction of the screwdriver into an adjustment box is possible.

Figure 13:
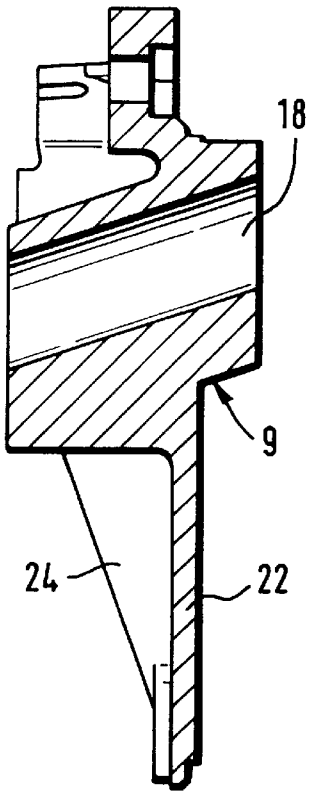
FIG. 13 is a section view taken along line XIII—XIII of FIG. 11.
Figure 12:
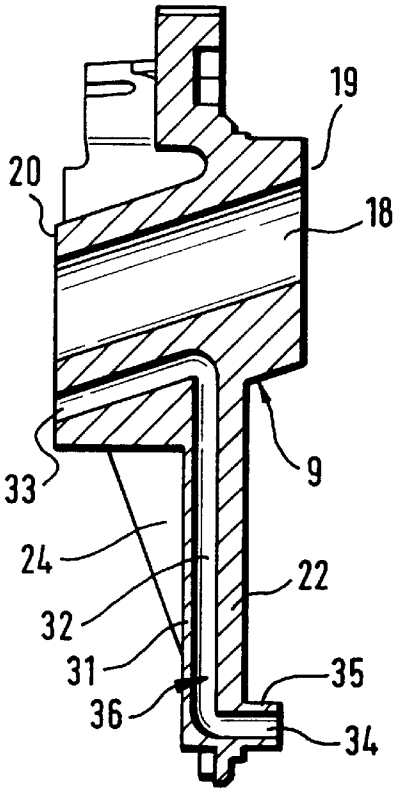
FIG. 12 is a section view taken along line XII—XII of FIG. 11.
Figure 11:
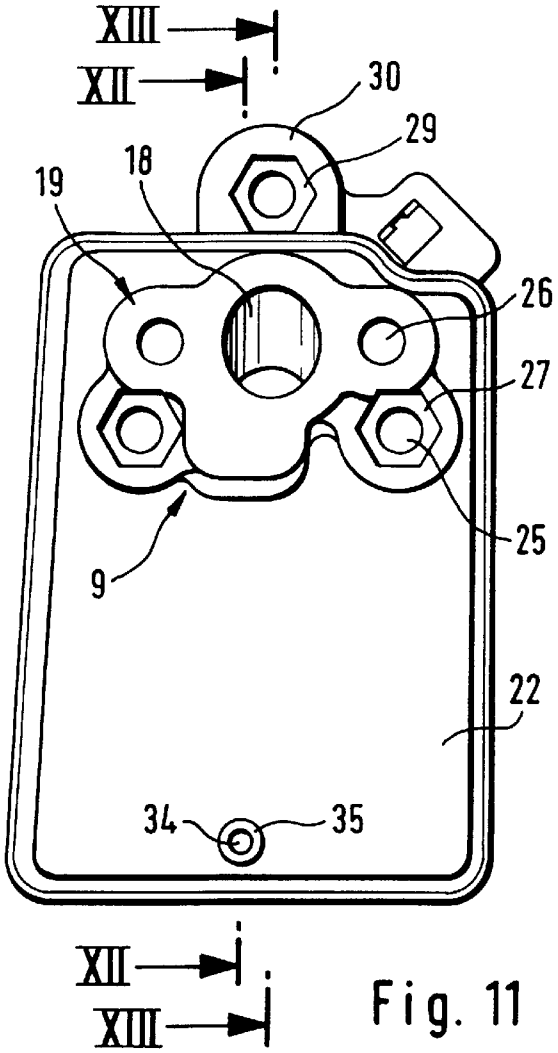
FIG. 11 shows another embodiment of the component of FIG. 5.

FIGS. 11, 12 and 13 show another embodiment of the component defining the spacer 9 and the air guiding plate 22. The arrangement of the flanges 19 and 20 as well as the course of corresponding flange planes E1 and E2 is the same as in the embodiment as shown in FIGS. 4 to 10. Compared to the configuration shown in FIGS. 4 to 10, the spacer 9 in FIGS. 11 to 13 has a greater volume in its lower region and the air guiding plate 22 has a larger material thickness.

As shown in FIG. 12, a cast portion 31 is located on the side of the air guiding plate 22 facing away from the engine and a channel 32 is formed therein. At one of its ends, this channel 32 extends into a channel section 33 in the spacer 9. The other end of the channel 32 extends into channel section 34 of a connecting stub 35 at right angles to the engine. The channel sections 32, 33 and 34 conjointly form a pulse channel 36 which extends from the crankcase of the engine to a fuel pump in the carburetor housing.

In FIG. 11, of the pulse channel, only the connecting stub 35 with the channel section 34 formed therein can be seen.

FIG. 13 is a section view taken along the line XIII—XIII of FIG. 11. FIG. 13 shows that the air guiding plate 22 has a longitudinal thickening in the form of portion 31 shown in FIG. 12 for forming the pulse channel 36. The air guiding plate 22 has the thickness shown in FIG. 13 over the remaining surface thereof. The pulse line 36 is integrated into the component formed from the spacer 9 and the air guiding plate 22. With the pulse line 36, a connection between the crankcase and the fuel pump is established in a simple manner without additional tube lines being necessary as was previously the case.

It is understood that the foregoing description is that of the preferred embodiments of the invention and that various changes and modifications may be made thereto without departing from the spirit and scope of the invention as defined in the appended claims.

What is claimed is:

1. An internal combustion engine assembly for a portable handheld work apparatus, the internal combustion engine assembly comprising:

an internal combustion engine having an inlet opening and an engine block;

a carburetor having an intake channel;

a spacer for connecting said carburetor to said engine;

said spacer having a channel section formed therein fluidly connecting said intake channel to said inlet opening;

said spacer having a first flange lying in contact engagement with said engine block and a second flange for receiving said carburetor;

said first and second flanges defining first and second flange planes, respectively, extending at least approximately parallel to each other; and, said channel section extending diagonally to said flange planes.

2. The internal combustion engine assembly of claim 1, said channel section extending linearly over the entire length thereof and defining a longitudinal axis; and, said longitudinal axis defining equal angles ($\alpha$, $\beta$) with respect to said first and second flange planes, respectively.

3. The internal combustion engine assembly of claim 2, wherein said angles ($\alpha$, $\beta$) are approximately 70°.

4. The internal combustion engine assembly of claim 1, wherein said engine includes a cylinder defining a longitudinal axis; and, said flange planes extending at least approximately parallel to said longitudinal axis of said cylinder.

5. The internal combustion engine assembly of claim 1, wherein said engine block includes cooling ribs formed thereon; and, said spacer has an air guiding plate disposed thereon extending in spaced relationship to the ends of said cooling ribs.

6. The internal combustion engine assembly of claim 5, wherein said air guiding plate is planar and extends in a plane parallel to said flange planes.

7. The internal combustion engine assembly of claim 5, wherein said air guiding plate has a side facing away from said engine block; and, said air guiding plate has at least one reinforcement element on said side thereof.

8. The internal combustion engine assembly of claim 7, wherein said reinforcement element is configured as a rib.

9. The internal combustion engine assembly of claim 5, wherein said spacer with said air guiding plate is formed from a single injection molded part.

10. The internal combustion engine assembly of claim 5, wherein said spacer and said air guiding plate conjointly define a pulse channel integrated therein.

11. The internal combustion engine assembly of claim 10, wherein said air guiding plate includes a connecting stub defining a first end of said pulse channel; said connecting stub being at an angle to said air guiding plate; and, said pulse channel having a second end formed as an opening in said second flange receiving said carburetor.

12. The internal combustion engine assembly of claim 1, wherein said spacer has fastening openings formed therein laterally of and next to said channel section; and, said fastening openings are adapted to receive or to allow fastening means to be passed therethrough.

13. The internal combustion engine assembly of claim 12, wherein said fastening openings are configured as substantially cylindrical openings running parallel to each other and arranged in respectively different planes referred to an elevation of said spacer.

14. The internal combustion engine assembly of claim 13, wherein said fastening openings are configured as through openings extending from said first flange plane to said second flange plane.

15. The internal combustion engine assembly of claim 13, further comprising insert parts defining respective inner threads disposed in at least a portion of said fastening holes.

16. The internal combustion engine assembly of claim 1, wherein said carburetor has a top side; and, said assembly further comprising a purger mounted in said top side of said carburetor.

* * * * *